US006364514B1

(12) United States Patent
Natsume

(10) Patent No.: US 6,364,514 B1
(45) Date of Patent: Apr. 2, 2002

(54) VEHICULAR INDICATOR LAMP

(75) Inventor: Kazunori Natsume, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/726,030

(22) Filed: Nov. 30, 2000

(30) Foreign Application Priority Data

Nov. 30, 1999 (JP) ..... 11-340033

(51) Int. Cl.[7] ..... F21V 13/04

(52) U.S. Cl. ..... 362/522; 362/517; 362/297; 362/305; 362/309; 362/335

(58) Field of Search ..... 362/516–518, 362/520–522, 296, 297, 304, 305, 308, 309, 326, 328, 335–339, 341, 347, 350

(56) References Cited

U.S. PATENT DOCUMENTS

| | | | | | |
|---|---|---|---|---|---|
| 3,558,869 | A | | 1/1971 | Levin et al. | 362/538 |
| 4,035,631 | A | * | 7/1977 | Day, Jr. | 362/297 |
| 4,953,063 | A | | 8/1990 | Nino | 362/61 |
| 5,045,982 | A | * | 9/1991 | Lyons | 362/304 |
| 5,055,981 | A | | 10/1991 | Nino | 362/61 |
| 5,755,503 | A | * | 5/1998 | Chen et al. | 362/297 |
| 5,945,916 | A | * | 8/1999 | Collot | 362/328 |
| 6,109,772 | A | * | 8/2000 | Futami et al. | 362/517 |
| 6,244,731 | B1 | * | 6/2001 | Koiko et al. | 362/297 |

* cited by examiner

*Primary Examiner*—Alan Cariaso
(74) *Attorney, Agent, or Firm*—Sughrue Mion, PLLC

(57) ABSTRACT

A vehicular lamp fixture, such as an indicator lamp, having an improved external appearance and originality. Diffusion lens elements are arranged at predetermined positions offset from a lamp fixture optical axis of an inner lens. The lens element optical axes of the diffusion lens elements pass through a boundary that divides the reflective surface of a reflector into an inner peripheral area and an outer peripheral area, each of which approaches a paraboloid of revolution centered on the lamp fixture optical axis. The reflective surface is formed as a curved surface curving forward of the paraboloid of revolution P. Light from a filament is irradiated as convergent light in a radial direction onto the diffusion lens elements, causing the diffusion lens elements to shine brightly and causing an image of the filament to appear reflected at central positions of the diffusion lens elements when seen from the front of the lamp fixture. As an external viewpoint is moved in a radial direction, the image of the filament moves to the side opposite to the direction in which the viewpoint moves.

20 Claims, 9 Drawing Sheets

VEHICULAR INDICATOR LAMP

BACKGROUND OF THE INVENTION

The present invention relates to a vehicular indicator lamp, and more particularly to a structure for enhancing the appearance of such a lamp.

As shown in FIG. 9, generally a vehicular indicator lamp is provided with a light source bulb 2 having a filament 2*a*, a reflector 4 for reflecting light from the light source bulb 2 in the forward direction, and a front lens 6 provided forward of the reflector 4. In a conventional vehicular indicator lamp as shown in FIG. 9, the reflective surface 4*a* of the reflector 4 is formed as a paraboloid of revolution with respect to the optical axis Ax of the lamp fixture as the central axis. A plurality of fish eye lenses 6s are formed in the front lens 6. As a result, reflected parallel light from the reflective surface 4*a* is diffused by each of the fish eye lenses 6*s* in the vertical and lateral directions.

However, in the above conventional vehicular indicator lamp, as the visible structure is primarily simply a plurality of fish eye lenses 6*s* formed in the front lens 6, the resultant appearance of the lamp, when viewed from the front, looks plain, thus making the lamp fixture unattractive.

SUMMARY OF THE INVENTION

The present invention has been conceived in consideration of the above, and it is an object of the invention to provide an indicator lamp for a vehicle which is provided with an enhanced appearance by imparting originality to the lamp housing design.

The present invention achieves the above object by a novel design of the structure of the reflector and the front lens.

Namely, the vehicular indicator lamp according to the present invention is provided with a light source disposed on the optical axis of a lamp fixture, a reflector for reflecting light from the light source in the forward direction, and a front lens disposed forward of the reflector, wherein diffusion lens elements are formed at predetermined positions offset from the lamp fixture optical axis of the front lens, the reflective surface of the reflector is divided into an inner peripheral area and an outer peripheral area having a boundary formed by a lens element optical axis that is parallel to the lamp fixture optical axis and that passes through central positions of the diffusion lens elements, the inner peripheral area and the outer peripheral area approach a paraboloid of revolution that has the lamp fixture optical axis as a center axis on the lens element optical axis and are formed as a curved surface that curves forward of the paraboloid of revolution, and light from the light source is irradiated onto the diffusion lens elements as convergent light in a radial direction.

The front lens may be a normal outer lens or an inner lens provided inside the lamp fixture.

There is no particular limitation on the specific configuration of the diffusion lens element so long as it is a lens element that has a diffusing function formed at a predetermined position offset from the lamp fixture optical axis of the front lens. The predetermined position is not limited to a specific position, provided that, when the diffusion lens element is formed, the position can serve to divide the reflective surface of the reflector into an inner peripheral area and an outer peripheral area with the optical axis of the lens element as the boundary therebetween.

The convergent light in a radial direction refers to light that converges within a cross section that includes the optical axis of the lamp fixture.

In the vehicular indicator lamp according to the present invention, diffusion lens elements are formed at predetermined positions offset from the lamp fixture optical axis of the front lens. Moreover, the reflective surface of the reflector is divided into an outer peripheral area and an inner peripheral area, with the lens element optical axis that is parallel with the lamp fixture optical axis passing through a central position of the diffusion lens element as a boundary. The inner peripheral area and outer peripheral area approach a paraboloid of revolution revolved around the lamp fixture optical axis as the central axis on the lens element optical axis, and together they constitute a curved surface curving forward of the paraboloid of revolution. The above-described structure causes light from the light source to strike the diffusion lens element as convergent light in a radial direction, making it possible to obtain the following operational effects.

As convergent light in a radial direction is incident on the diffusion lens element, the diffusion lens element appears to shine more brightly compared with the case when parallel light is incident on the diffusion lens element, as is the case conventionally. Since the inner peripheral area and outer peripheral area constitute a curved surface approaching a paraboloid of revolution on the lens element optical axis, the image of the light source appears to be reflected at a central position of the diffusion lens element when seen from the front of the lamp fixture. In addition, the inner peripheral area and outer peripheral area are curved forward of the paraboloid of revolution. As the viewpoint changes from the front of the lamp fixture to the radial direction of the lamp fixture optical axis, the light source image moves from the central position of the diffusion lens element towards the opposite side to the direction in which the viewpoint changes.

Therefore, according to the present invention, it is possible to impart originality to the lamp fixture design, thus enhancing the appearance thereof.

In the above-described structure, assuming that the front surface of the diffusion lens element is formed as a non-spherical curve in which the radius of curvature Rh of a horizontal cross section and the radius of curvature Rv of a vertical cross section are set such that Rv>Rh, the transmitted light of the diffusion lens element forms a transversely extended light distribution pattern which extends further in the horizontal direction than in the vertical direction. As a result, it is possible to easily obtain the desired lamp fixture light distribution pattern.

It is possible to use only a single diffusion lens element. However, if diffusion lens elements are formed at a plurality of locations spaced at predetermined intervals in a circumferential direction centered on the lamp fixture optical axis, it is possible to realize the above-described appearance with a scattered placement. Therefore, the lamp fixture design can be provided with still more originality, and, as a result, the appearance of the lamp fixture can be even more enhanced.

With respect to the above-mentioned reflective surface, so long as the inner peripheral area and the outer peripheral area are formed to approach a paraboloid of revolution with the lamp fixture optical axis as the central axis on the lens diffusion optical axis and to constitute a curved surface curving forward of the paraboloid of revolution, there is no particular restriction as to the shape of the curved surfaces in the circumferential direction. However, if the reflective surface is formed from a plurality of reflective elements separated in the circumferential direction around the lamp fixture optical axis, each of these reflective elements is formed as a curved surface curving in the circumferential direction, and light from the light source is caused to strike each diffusion lens element as convergent light in the circumferential direction, light converging in the radial direction and in the circumferential direction strikes the diffusion lens elements. This enables the diffusion lens elements to appear to shine even more brightly. Moreover, by using this type of structure, the size of the diffusion lens element can be reduced or the distance between the reflective surface and the diffusion lens element can be shortened. It is thus possible to achieve an improvement in the originality of the lamp fixture design or to form a thinner lamp fixture. Here, the term "convergent light in the circumferential direction" refers to the light that converges within a circumferential cross-section centered on the lamp fixture optical axis.

In the above structure, providing a condensing lens element on the lamp fixture optical axis of the front lens makes it possible to condense direct divergent light traveling forward from the light source, which is effectively used for light distribution control.

DESCRIPTION OF THE PREFERRED EMBODIMENTS

Figure 1:
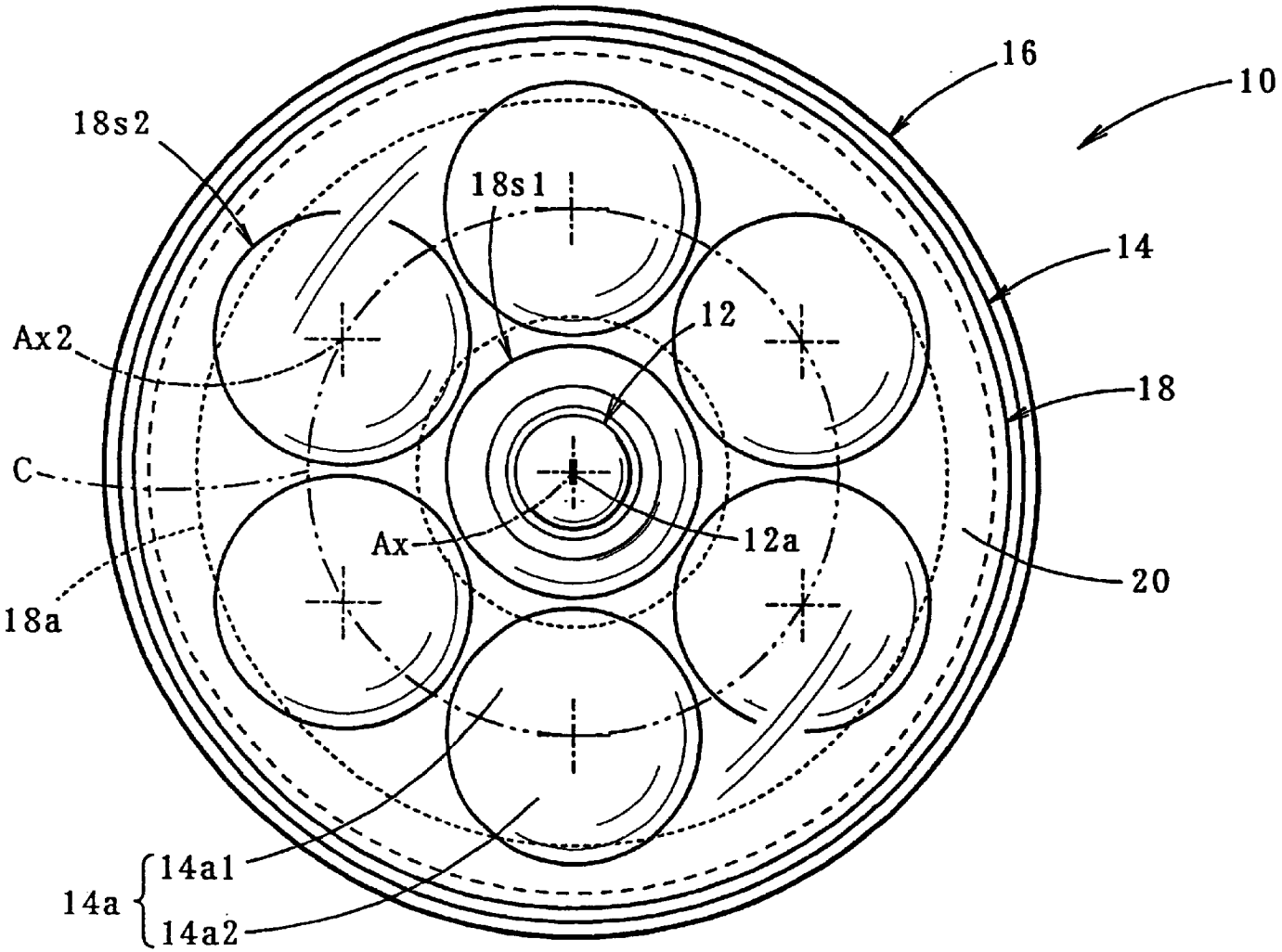
FIG. 1 is a front view showing a vehicular indicator lamp constructed according to a first embodiment of the present invention.

Preferred embodiments of the present invention now will be described referring to the drawings.

Firstly, a first embodiment of the present invention will be described.

Figure 2:
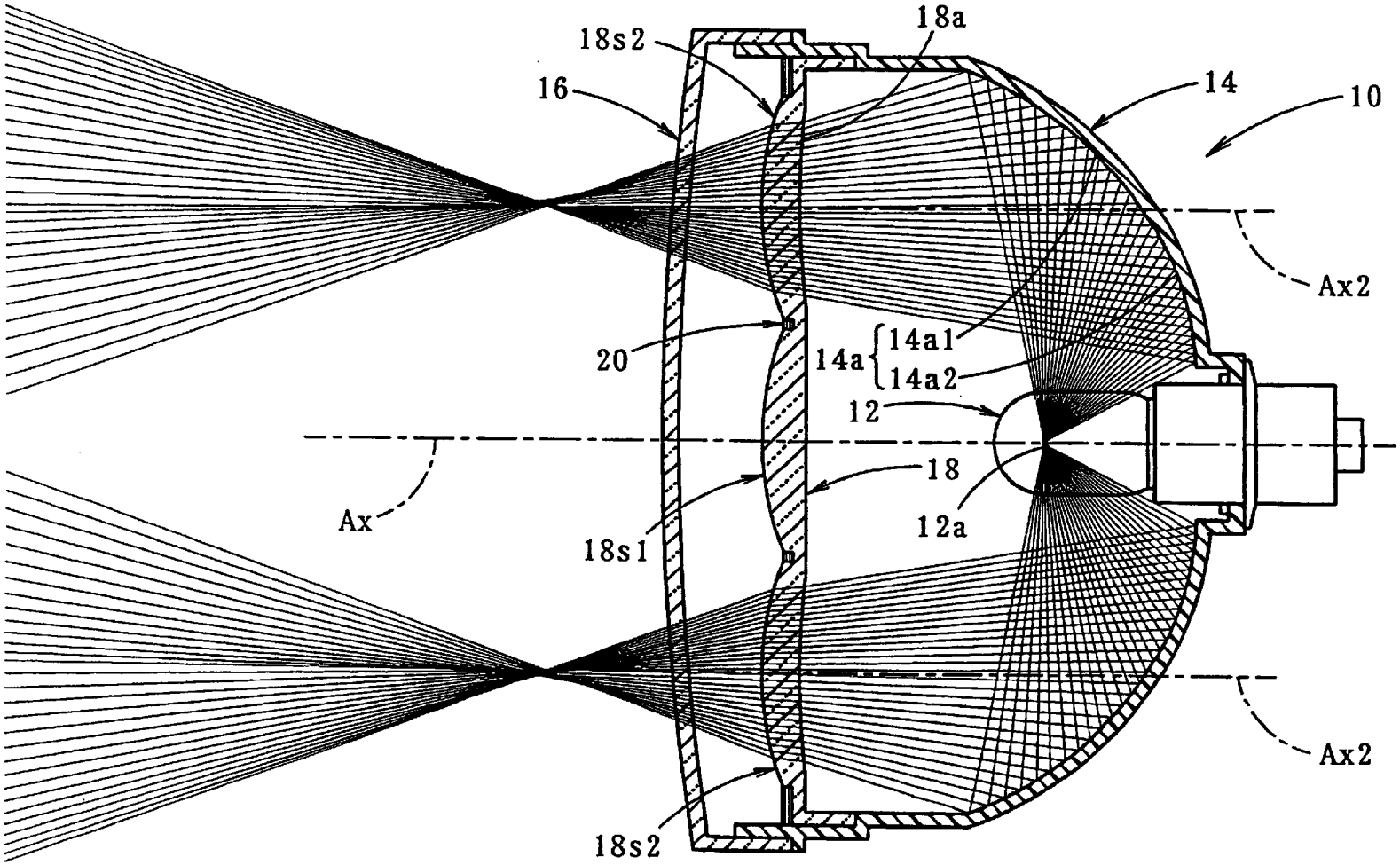
FIG. 2 is a sectional side elevational view showing the vehicular indicator lamp according to the first embodiment depicting the operation of each diffusion lens element.
Figure 3:
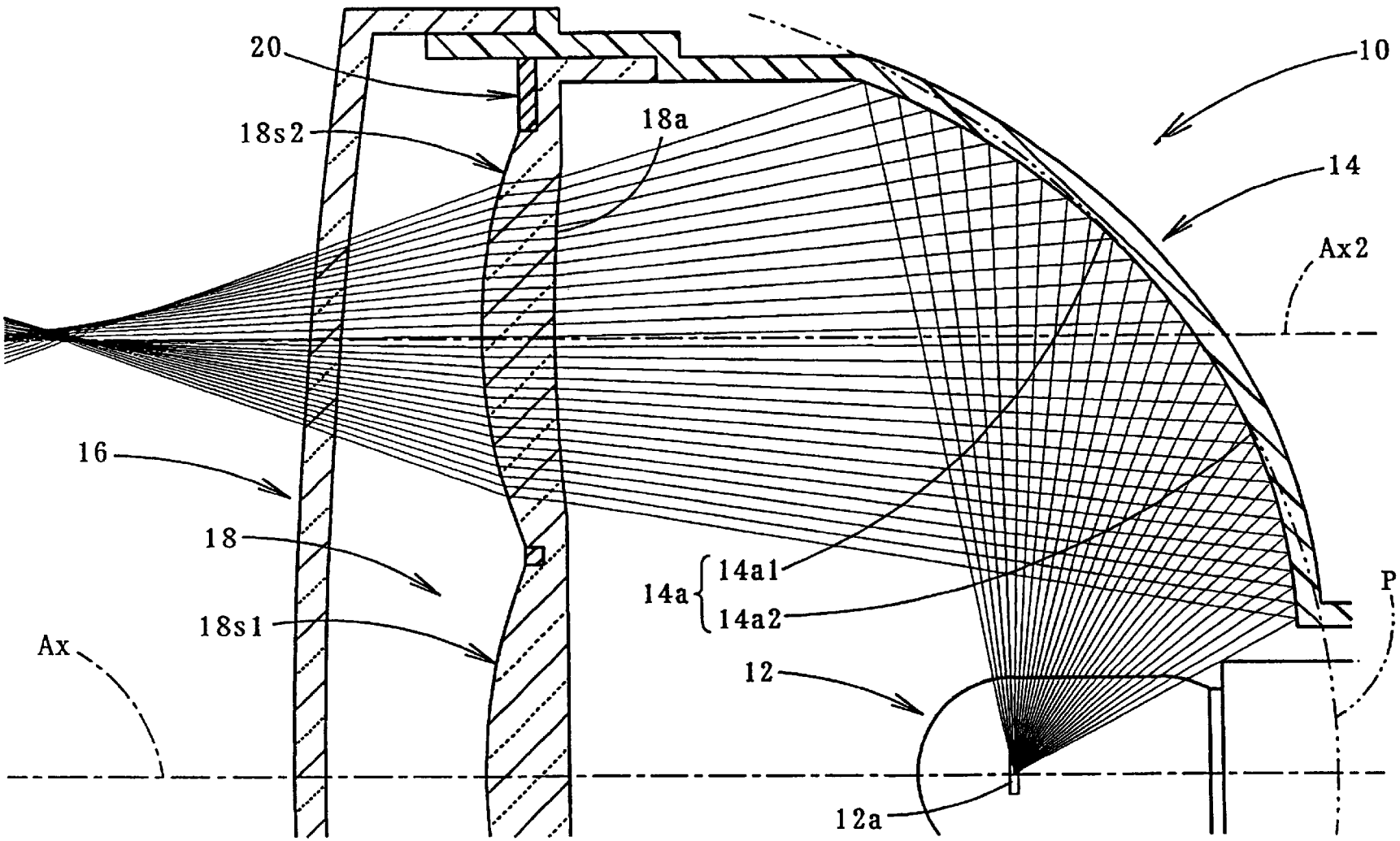
FIG. 3 is a detailed view of essential elements shown in FIG. 2.

FIG. 1 is a front view showing a vehicular indicator lamp 10 according to the first embodiment, FIG. 2 is a sectional side elevation thereof, and FIG. 3 is a detailed view of essential elements shown in FIG. 2.

As is shown in these figures, the vehicular indicator lamp 10 according to the present embodiment is a tail lamp, which is provided with a light source bulb 12 disposed on a lamp fixture optical axis Ax extending in the longitudinal direction of the vehicle on which the lamp is mounted, a reflector 14 for reflecting light from a filament 12*a*(i.e., the light source) of the light source bulb 12 in the forward direction (i.e., in the forward direction relative to the lamp housing but in the rearward direction relative to the vehicle—the same applies to the description which follows), a transparent outer lens 16 provided forward of the reflector 14, an inner lens 18 (i.e., the front lens) provided at a position between the outer lens 16 and the reflective surface 14*a* of the reflector 14, and a multiple-apertured ornamental panel 20 attached to the front surface of the inner lens 18.

The vehicular indicator lamp 10 is shaped to have a circular outline. At the outer peripheral edge portion thereof the outer lens 16 is fused to the reflector 14, while at the inner peripheral side thereof the outer peripheral edge portions of the inner lens 18 are fused to the reflector 14.

The light source bulb 12 is attached to the rear apex portion of the reflector 14 in a state where the filament 12*a*of the light source bulb 12 extends in a vertical direction along the lamp fixture optical axis Ax.

The inner lens 18 has a condensing lens element 18s1 formed on the lamp fixture optical axis Ax, and six diffusion lens elements 18s2 formed at positions offset from the lamp fixture optical axis Ax. The portions other than the condensing lens element 18s1 and the six diffusion lens elements 18s2 are formed in a planar shape.

The condensing lens element 18s1 has a circular outline, and the outline of each of the diffusion lens elements 18s2 is also set as a circle having the same size as the condensing lens element 18s1. In addition, six diffusion lens elements 18s2 are arranged at equal intervals in the circumferential direction so as to surround the condensing lens element 18s1. Lens element optical axes Ax2 that pass through respective positions at the center of each diffusion lens element 18s2 parallel to the lamp fixture optical axis Ax pass through the circumference of a circle C.

A ring-like concave curved surface 18*a* is formed on the rear surface of the inner lens 18 centered on the lamp fixture optical axis Ax. The width in the radial direction of this ring-like concave curved surface 18*a* is set to a value slightly smaller than the size of the outer diameter of the diffusion lens elements 18s2, and the center of the width of the ring-like concave curved surface 18*a* is set on the circle C.

The front surfaces of the condensing lens element 18s1 and each diffusion lens element 18s2 are all formed as convex curved surfaces (described in detail below). However, the rear surface of the condensing lens element 18s1 is flat, while the rear surface of each diffusion lens element 18s2 is curved in the radial direction because of the presence of the above-described ring-like concave curved surface 18*a*. As a result, the condensing lens element 18s1 constitutes a planoconvex lens, while each of the diffusion lens elements 18s2 constitutes a meniscus lens having positive refracting power in the radial direction and a planoconvex lens in the circumferential direction.

The multiple-apertured ornamentation panel 20 is formed from a thin non-transparent panel (for example, a white synthetic resin panel) in which circular holes with the same size as the respective lens elements are formed at positions corresponding to the condensing lens element 18s1 and each diffusion lens element 18s2.

As is shown in FIG. 3, the reflective surface 14*a* of the reflector 14 is formed with a paraboloid of revolution P having the lamp fixture optical axis Ax as its central axis and the position of the filament 12*a*on the lamp fixture optical axis Ax as its focus as a reference surface.

That is, the reflective surface 14*a* is divided into an inner peripheral area 14a1 and an outer peripheral area 14a2 with the lens element optical axis Ax2 as the boundary therebetween. The inner peripheral area 14a1 and the outer peripheral area 14a2 approach the paraboloid of revolution P on the lens element optical axis Ax2 and form a curved surface curving forward of the paraboloid of revolution P. They further cause light from the filament 12*a*to strike each of the diffusion lens elements 18s2 as convergent light in the radial direction. The reflective surface 14*a* has the same cross-sectional configuration over its entire circumference, and is formed with the circle C as the boundary between the inner peripheral area 14a1 and the outer peripheral area 14a2 when viewed from the front of the lamp fixture.

As is shown in the figures, convergent light in the radial direction that strikes each diffusion lens element 18s2 from the reflective surface 14*a* is further converged and deflected by the diffusion lens elements 18s2 towards the lens element optical axis Ax2 and is irradiated forward of the lamp fixture. Once this irradiated light has been converged, it is irradiated forward of the lamp housing as diffused light in the radial direction.

It is to be noted that the convergent light in the radial direction that strikes each diffusion lens element 18s2 from the reflective surface 14*a* is parallel light in the circumferential direction. It is, however, irradiated forward of the lamp fixture as light that is also diffused in the circumferential direction by the diffusing action of the diffusion lens elements 18s2.

Figure 4B:
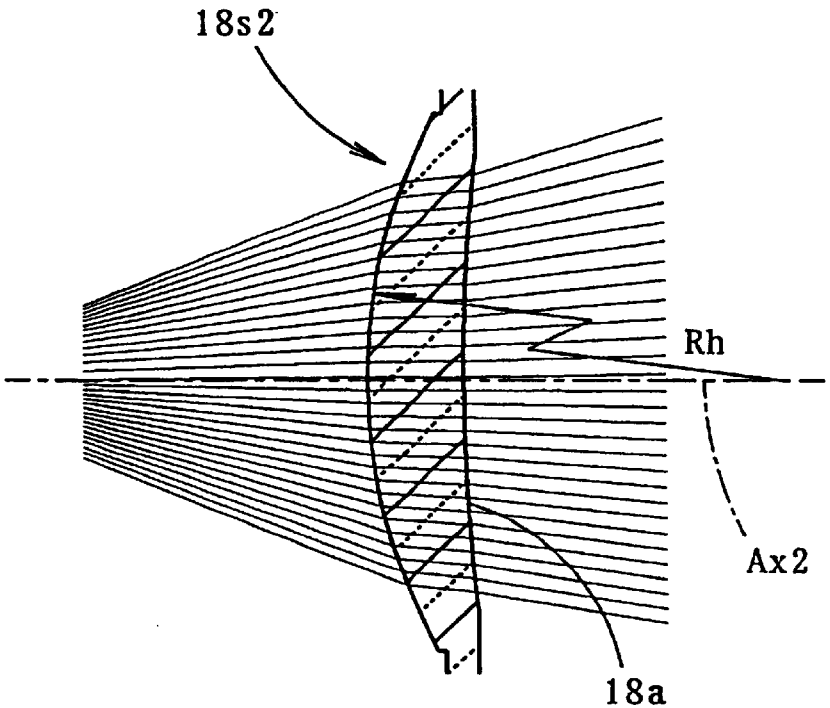
FIG. 4B is a top cross-sectional view thereof.
Figure 4A:
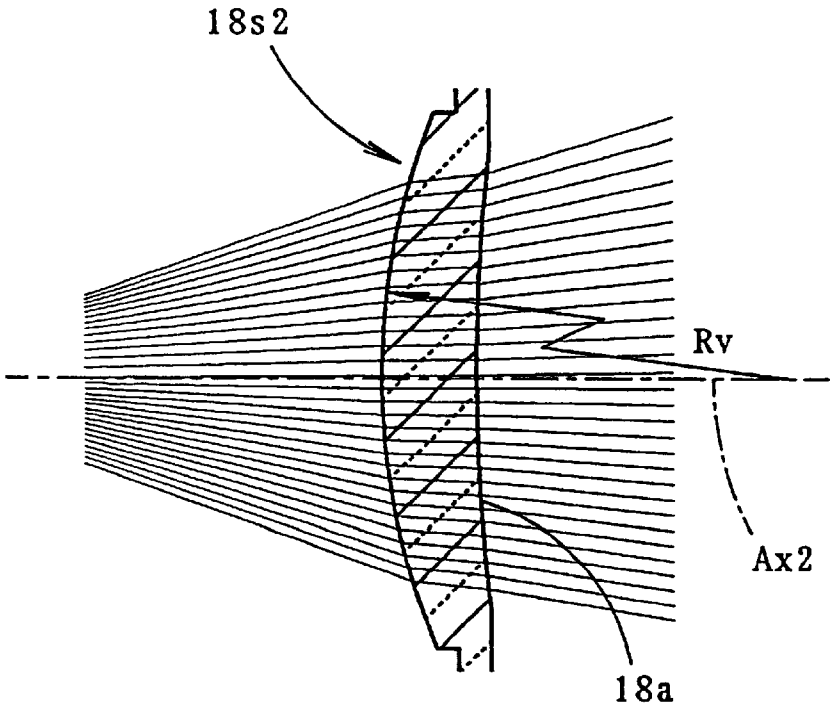
FIG. 4A is a sectional side elevational view showing a single diffusion lens element in the first embodiment.

FIG. 4A is a sectional side elevational view of a single diffusion lens element 18s2, while FIG. 4B is a top cross-sectional view of the single diffusion lens element 18s2.

As shown in these figure, the concave curved surface that forms the front surface of each diffusion lens element 18s2 is not a simple spherical surface but is formed as a non-spherical surface in which the radius of curvature Rv of the vertical cross-section and the radius of curvature Rh of the horizontal cross-section are set such that Rv>Rh.

By forming the front surface of each diffusion lens element 18s2 as this type of the non-spherical surface, the power to refract the light transmitted through the diffusion lens elements 18s2 is larger within the horizontal cross-section than within the vertical cross-section. As a result, there is formed a transversely extended light distribution pattern that extends further in the horizontal direction than in the vertical direction.

The same figures clearly show the difference in the optical paths due to different radii of curvature. The rear surface of each diffusion lens element 18s2 is shown to be formed with the same concave curved surface (the ring-like concave curved surface 18*a*) for both FIG. 4A and FIG. 4B.

The convex curved surface constituting the front surface of the condensing lens element 18s1 is also formed as a non-spherical surface with exactly the same shape as each of the diffusion lens elements 18s2.

Figure 5:
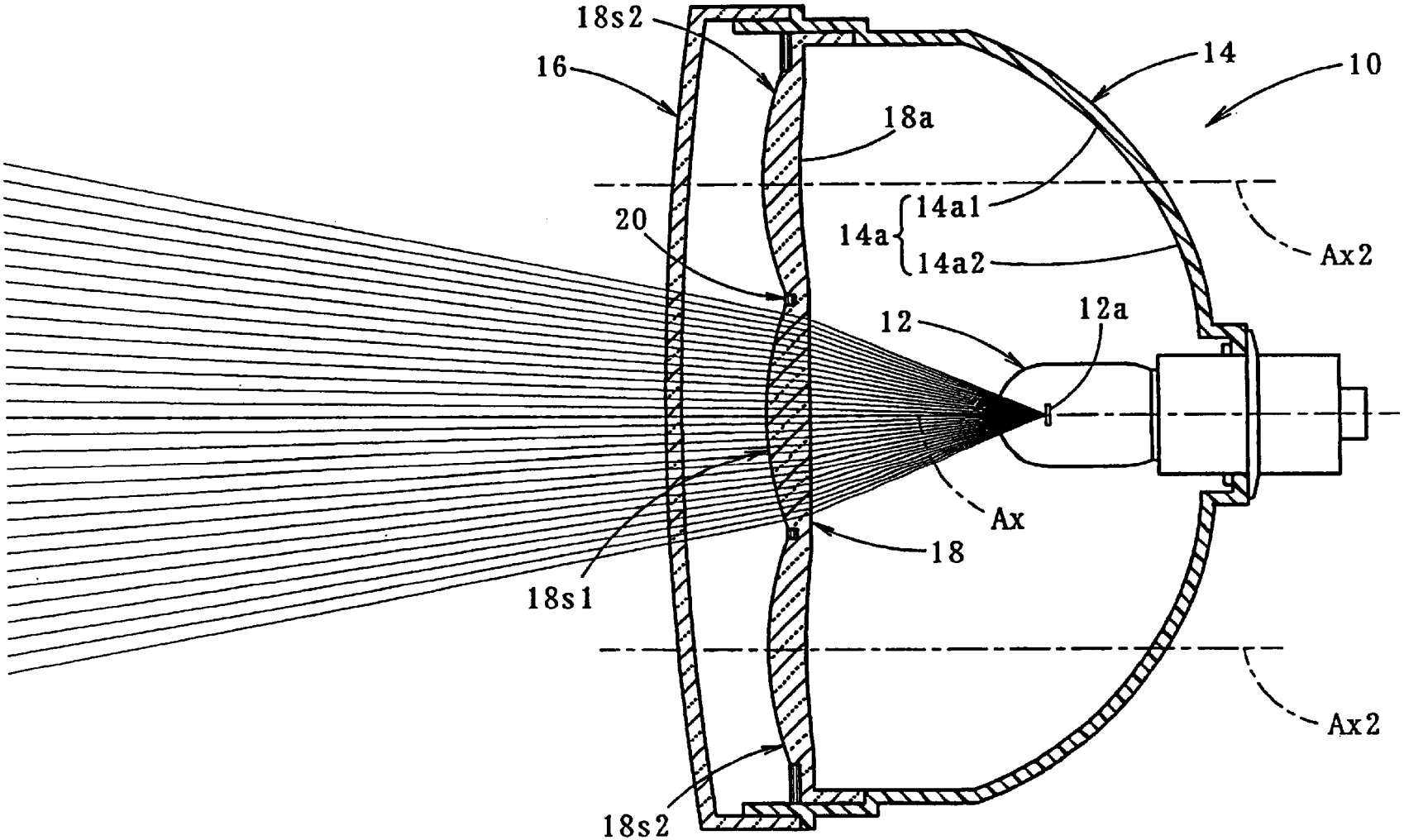
FIG. 5 is a sectional side elevational view showing the vehicular indicator lamp according to the first embodiment depicting the operation of the condensing lens element.

As shown in FIG. 5, direct divergent light traveling from the filament 12*a* towards the condensing lens element 18s1 is converged and deflected by the condensing lens element 18s1 towards the lamp fixture optical axis Ax, and is emitted forward. The emitted light is then irradiated forward of the lamp fixture as diffused light. Since the front surface of the condensing lens element 18s1 is formed as the above-described non-spherical surface, a longitudinally extending light distribution pattern that extends further in the vertical direction than in the horizontal direction is formed by the light transmitted through the condensing lens element 18s1.

Figure 6:
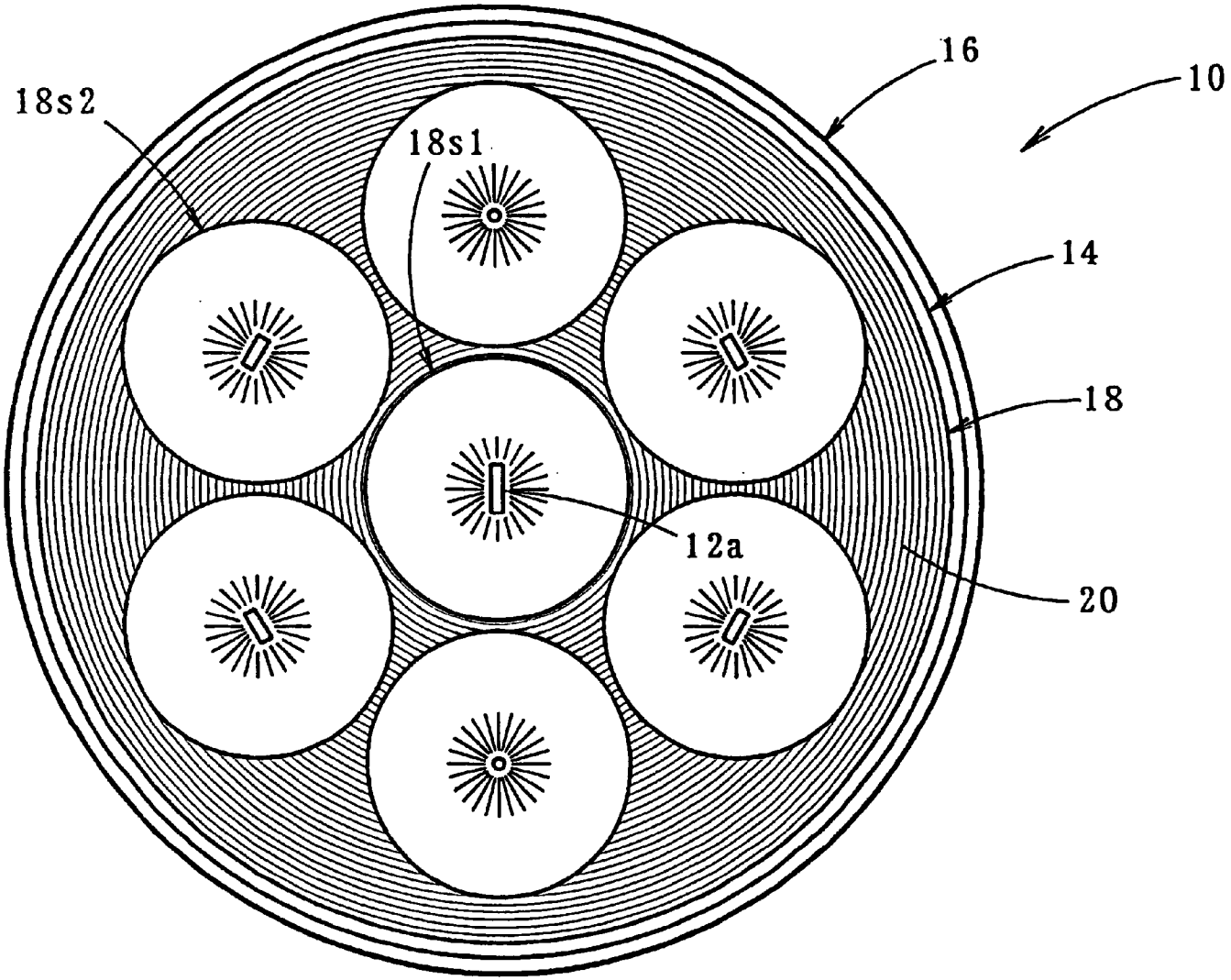
FIG. 6 is a view showing the vehicular indicator lamp according to the first embodiment in an illuminated state as seen from the front of the lamp fixture.

FIG. 6 is a view showing the vehicular indicator lamp 10 in an illuminated state as seen from the front of the lamp fixture.

As shown in FIG. 6, with a multiple-apertured ornamentation panel 20 attached to the front surface of the inner lens 18, the condensing lens element 18s1 and the diffusion lens elements 18s2 of the inner lens 18 inside of the lamp fixture appear brightly as identically sized circles. The remaining portion is shaded and appears dark.

Moreover, at a central position of the condensing lens element 18s1 (namely, on the lamp fixture optical axis Ax), the filament 12*a* appears enlarged due to the convex lens action of the condensing lens element 18s1. In addition, at a central position of each diffusion lens element 18s2 (namely, on the lens element optical axis Ax2), the image of the filament 12*a* reflected by the reflective surface 14*a* appears enlarged due to the convex lens action of the diffusion lens elements 18s2. Since the inner and outer peripheral areas 14a1 and 14a2 of the reflective surface 14*a* are formed to approach the paraboloid of revolution P on the lens element optical axis Ax2, the image of the filament 12*a*appears reflected at the central position of each diffusion lens element 18s2. As further shown in FIG. 6, the configurations of the various images of the filament 12*a* that appear reflected at a central position of the respective diffusion lens elements 18s2 differ from each other depending on the positional relationships between the respective diffusion lens elements 18s2 and the lamp fixture optical axis Ax.

When the vehicular indicator lamp 10 is viewed from the front of the lamp fixture when it is not illuminated, the light source bulb 12 and the reflective surface 14*a* can be seen at the back of the multiple-apertured ornamentation panel 20 through the condensing lens element 18s1 and the diffusion lens elements 18s2.

As has been described in detail, in the vehicular indicator lamp 10 according to the present embodiment, diffusion lens elements 18s2 are formed at predetermined positions offset from the lamp fixture optical axis Ax of the inner lens 18, and the reflective surface 14*a* of a reflector 14 is divided into an inner peripheral area 14a1 and an outer peripheral area 14a2 by a boundary as the lens element optical axis Ax2 of the diffusion lens elements 18s2. Moreover, the inner peripheral area 14a1 and an outer peripheral area 14a2 approach a paraboloid of revolution P, which has the lamp fixture optical axis Ax as its central axis on the lens element optical axis Ax2, and constitute curved surfaces curved forward of the paraboloid of revolution P. Further, light from the filament 12*a* is irradiated as convergent light in the radial direction onto the diffusion lens elements 182. As a result, the following operation and effects can be obtained.

As convergent light in the radial direction is irradiated onto the diffusion lens elements 18s2, the diffusion lens elements 18s2 appear to shine more brightly compared with the conventional case in which the parallel light is irradiated thereon. Moreover, because the inner peripheral area 14a1 and the outer peripheral area 14a2 are formed as curved surfaces that approach the paraboloid of revolution P on the lens element optical axis Ax2, an image of the filament 12*a* appears reflected at the central position of the diffusion lens elements 18s2 when seen from the front of the lamp fixture. Moreover, the inner peripheral area 14a1 and the outer peripheral area 14a2 curve forward of the paraboloid of revolution P. As the viewpoint is moved from the front of the lamp fixture in a radial direction on the lamp fixture optical axis Ax, the image of the filament 12*a* moves from the central position of the diffusion lens elements 18s2 to the side opposite to the direction in which the viewpoint moves. This makes it possible to impart originality to the lamp fixture design, enhancing the appearance of the lamp fixture.

Furthermore, in the present embodiment, the diffusion lens elements 18s2 are formed at plural positions (i.e., six) at predetermined intervals in a circumferential direction centered on the lamp fixture optical axis Ax. It is thus possible to realize the above-described appearance with a scattered placement, and therefore the lamp fixture design can be provided with further originality.

Moreover, the front surface of each diffusion lens element 18s2 is formed as a non-spherical surface in which the radius of curvature Rv of the vertical cross-section and the radius of curvature Rh of the horizontal cross-section are set such that Rv>Rh, and a transversely extended light distribution pattern is formed by the light transmitted through each diffusion lens element 18s2. Accordingly, it is possible to easily obtain the desired lamp fixture light distribution pattern.

In the present embodiment, the condensing lens element 18s1 is formed on the lamp fixture optical axis Ax of the inner lens 18, which makes it possible to condense direct divergent light traveling from the filament 12*a* forward and to use it effectively for light distribution control. Since the convex curved surface constituting the front surface of the condensing lens element 18s1 is formed as a non-spherical surface having exactly the same shape as each of the diffusion lens elements 18s2, it is possible to realize uniformity in the design of the condensing lens element 18s1 and each of the diffusion lens elements 18s2. The appearance of the lamp fixture when the vehicular indicator lamp is not illuminated is thus further enhanced.

In this case, a ring-like concave curved surface 18*a* is formed in the rear surface of the inner lens 18. By suitably altering the radius of curvature of the cross section in the radial direction of the ring-like concave curved surface 18*a*, the configuration of the lamp fixture light distribution pattern may be changed while maintaining the uniformity of the front surface shape of each diffusion lens element 18s2 and the condensing lens element 18s1.

Next, a second embodiment of the present invention will be described.

Figure 7:
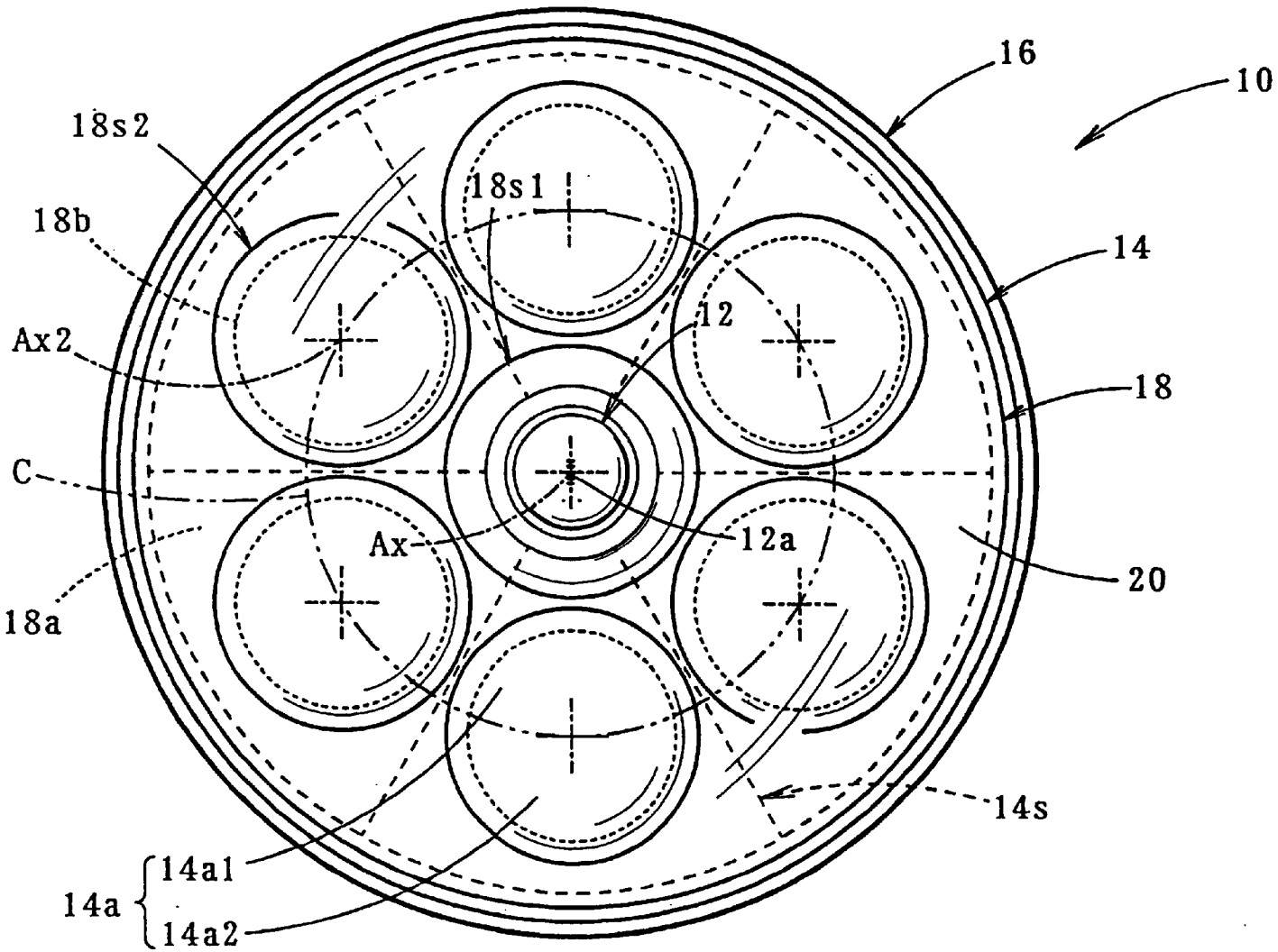
FIG. 7 is a front view showing the vehicular indicator lamp according to a second embodiment of the present invention.

FIG. 7 is a front view showing the vehicular indicator lamp 10 according to the second embodiment.

Referring to FIG. 7, in the second embodiment the reflective surface 14*a* is divided every 60° in a circumferential direction centered on the lamp fixture optical axis Ax so as to form six fan-shaped reflective elements 14*a* that correspond to the respective diffusion lens elements 18s2. Each fan-shaped reflective element 14*s* is formed as a curved surface curving in the circumferential direction. The reflective surface 14*a* is formed of an inner peripheral area 14a1 and an outer peripheral area 14a2, having the boundary of the circle C therebetween, in the same way as the first embodiment.

In the second embodiment, instead of the ring-like concave curved surface 18*a* of the first embodiment, spherical concave curved surfaces 18*b* having an outline slightly smaller than the outline of the front surface of the diffusion lens element 18s2 are formed on the rear surface of the inner lens 18 for each of the diffusion lens elements 18s2. The radius of curvature of each of the spherical concave curved surfaces 18b is set at a value greater than the radius of curvature of the front surfaces of each of the diffusion lens elements 18s2. As a result, each diffusion lens element 18s2 constitutes a meniscus lens having a positive refracting power.

The structure of the condensing lens element 18s1 in the second embodiment is exactly the same as that in the first embodiment.

Figure 8:
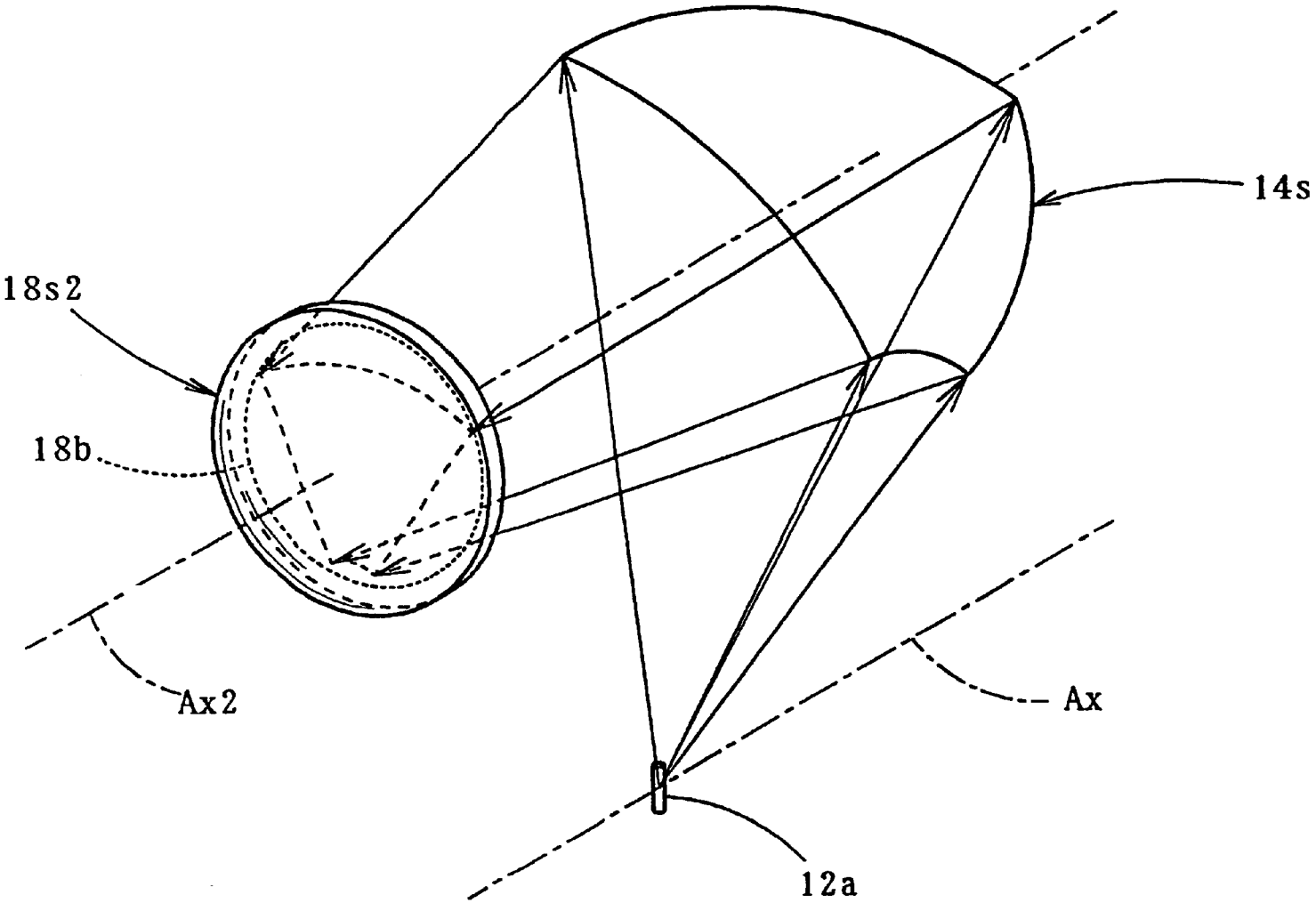
FIG. 8 is a perspective view showing a reflective element in combination with a diffusion lens element according to the second embodiment.
Figure 9:
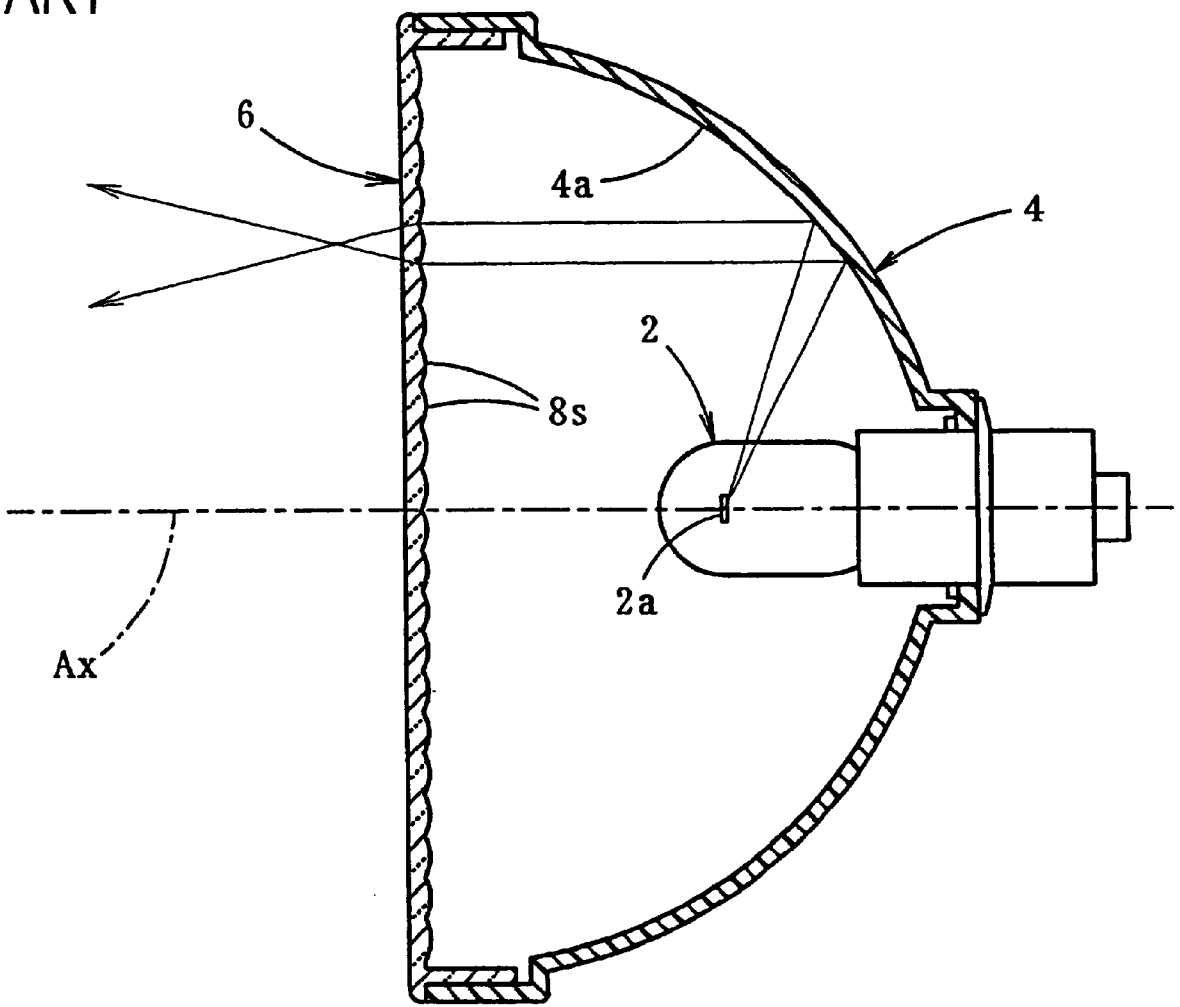
FIG. 9 PRIOR ART
FIG. 9 is a similar view to FIG. 2 showing a conventional example.

FIG. 8 is a perspective view showing the fan-shaped reflective element 14*s* in combination with the diffusion lens element 18s2 in the second embodiment.

Referring to FIG. 8, the fan-shaped reflective element 14*s* is formed by a curved surface curving in a radial direction and in a circumferential direction. The light from the filament 12*a*reflected by the fan-shaped reflective element 14*s* is irradiated onto the diffusion lens elements 18s2 as light that is convergent in the radial and circumferential directions. In this way, as the light that is convergent in both the radial and circumferential directions is irradiated onto each diffusion lens element 18s2, the diffusion lens elements 18s2 appears to shine even more brightly than in the first embodiment.

Like the first embodiment, an image of the filament 12*a* appears reflected at a central position in each diffusion lens element 18s2 when seen from the front of the lamp fixture. However, in the second embodiment, each fan-shaped reflective element 14*s* is formed as a curved surface curving in the radial and circumferential directions. Even when the viewpoint is moved from the front of the lamp fixture either in the radial direction or in the circumferential direction relative to the lamp fixture optical axis Ax, the image of the filament 12*a* moves, following the movement of the viewpoint, from the central position of the diffusion lens elements 18s2 to the side opposite to the direction in which the viewpoint moves. As a result, it is possible to further increase the originality in the lamp fixture design, thereby to further enhance the appearance of the lamp fixture.

The structure of the second embodiment allows the fan-shaped reflective elements 14*a* to irradiate reflected light onto the diffusion lens elements 18s2 even when the size thereof is reduced or the distance therebetween is shortened. This improves the originality of the lamp fixture design and realizes a thinner lamp fixture.

In the second embodiment, the convex curved surface constituting the front surface of the condensing lens element 18s1 is formed with a non-spherical surface having exactly the same shape as each of the diffusion lens elements 18s2. However, it is possible to employ another type of curved surface. For example, if the convex curved surface constituting the front surface of the condensing lens element 18s1 is formed as a non-spherical surface in which the radius of curvature Rv of a vertical cross section and the radius of curvature Rh of a horizontal cross section are set such that Rv<Rh, it is possible to form a transversely extending light distribution pattern by the transmitted light of the condensing lens element 18s1. Therefore, the desired lamp fixture light distribution pattern can be easily obtained. Alternatively, it is also possible to form the front surface of the condensing lens element 18s1 as a simple spherical curved surface. It is still further possible to form a reflex reflector (RR) instead of forming the condensing lens element 18s1 on the lamp fixture optical axis Ax of the inner lens 18.

In each of the above embodiments, the rear surface of the condensing lens element 18s1 is formed as a flat surface, and the rear surface of each diffusion lens element 18s2 is formed as a ring-like concave curved surface 18*a* or a spherical concave curved surface 18*b*. However, it is understood that the shape of the rear surface of each lens element may be suitably altered according to the demands of the light distribution properties of the lamp fixture and the like. Particularly, the rear surface of each lens element may be formed as a convex curved surface instead of the flat or concave curved surface.

In each of the above-described embodiments, the condensing lens element 18s1 and diffusion lens elements 18s2 are formed in the inner lens 18. However, it is possible to obtain the same operation and effects even if those lens elements are formed in the normal outer lens.

In each of the above-described embodiments, the vehicular indicator lamp 10 is a tail lamp. However, so long as the same general structure as in the above embodiments is employed, the same operation and effects as those of the embodiments can be obtained in other types of the vehicular indicator lamps.

What is claimed is:

1. A vehicular indicator lamp comprising a light source disposed on an optical axis of a lamp fixture, a reflector for reflecting light from said light source in a forward direction, and a front lens disposed forward of said reflector, wherein:

a plurality of diffusion lens elements are formed on said front lens at predetermined positions offset from said optical axis;

a reflective surface of said reflector is divided into an inner peripheral area and an outer peripheral area, said inner and outer peripheral areas having a boundary therebetween, optical axes of said diffusion lens elements being parallel to said lamp fixture optical axis and passing through said boundary and through central portions of said diffusion lens elements; and said inner and outer peripheral areas approach a paraboloid of revolution having said lamp fixture optical axis as a center axis, said inner and outer peripheral areas being formed as curved surfaces that curve forward of said paraboloid of revolution, and said inner and outer peripheral areas irradiating light from said light source onto said diffusion lens elements as convergent light in a radial direction.

2. The vehicular indicator lamp according to claim 1, wherein front surfaces of said diffusion lens elements are formed as non-spherical surfaces in which a radius of curvature Rv of a vertical cross section and a radius of curvature Rh of a horizontal cross section are set such that Rv>Rh.

3. The vehicular indicator lamp according to claim 1, wherein said diffusion lens elements are formed at a plurality of locations spaced at predetermined intervals in a circumferential direction centered on said lamp fixture optical axis.

4. The vehicular indicator lamp according to claim 3, wherein:

said reflective surface comprises a plurality of reflective elements divided in a circumferential direction centered on said lamp fixture optical axis; and each reflective element is formed of a curved surface curving in a circumferential direction so as to irradiate light from said light source onto each diffusion lens element as convergent light in a circumferential direction.

5. The vehicular indicator lamp according to claim 1, further comprising a condensing lens element formed on said front lens said lamp fixture and intersecting said lamp fixture optical axis.

6. The vehicular indicator lamp according to claim 5, wherein a front surface of said condensing lens element is formed as non-spherical surface in which a radius of curvature Rv of a vertical cross section and a radius of curvature Rh of a horizontal cross section are set such that Rv>Rh.

7. The vehicular indicator lamp according to claim 1, further comprising a multiple-apertured ornamentation panel fitted to a forward side of said front lens, each lens element of said front lens being received in a respective aperture of said ornamentation panel.

8. The vehicular indicator lamp according to claim 7, wherein said multiple-apertured ornamentation panel comprises a thin sheet of non-transparent synthetic resin.

9. The vehicular indicator lamp according to claim 1, wherein said reflective surface of said reflector has a constant cross-sectional configuration over its entire circumference.

10. The vehicular indicator lamp according to claim 1, wherein a ring-like concave curved surface is formed in a rear surface of said inner lens.

11. A vehicular indicator lamp comprising a light source disposed on an optical axis of a lamp fixture, a reflector for reflecting light from said light source in a forward direction, and a front lens disposed forward of said reflector, wherein:

a plurality of diffusion lens elements are formed on said front lens at predetermined positions offset from said optical axis;

a reflective surface of said reflector is divided into an inner peripheral area and an outer peripheral area, said inner and outer peripheral areas having a boundary therebetween, optical axes of said diffusion lens elements being parallel to said lamp fixture optical axis and passing through said boundary and through central portions of said diffusion lens elements, and said reflective surface is further divided radially into a plurality of fan-shaped reflective elements, one for each of said diffusion lens elements, each of said fan-shaped reflective elements curving in both radial and circumferential directions; and said inner and outer peripheral areas approach a paraboloid of revolution having said lamp fixture optical axis as a center axis, said inner and outer peripheral areas being formed as curved surfaces that curve forward of said paraboloid of revolution, and said inner and outer peripheral areas irradiating light from said light source onto said diffusion lens elements as convergent light in a radial direction.

12. The vehicular indicator lamp according to claim 11, wherein front surfaces of said diffusion lens elements are formed as non-spherical surfaces in which a radius of curvature Rv of a vertical cross section and a radius of curvature Rh of a horizontal cross section are set such that Rv>Rh.

13. The vehicular indicator lamp according to claim 11, wherein said diffusion lens elements are formed at a plurality of locations spaced at predetermined intervals in a circumferential direction centered on said lamp fixture optical axis.

14. The vehicular indicator lamp according to claim 11, further comprising a condensing lens element formed on said front lens said lamp fixture and intersecting said lamp fixture optical axis.

15. The vehicular indicator lamp according to claim 14, wherein a front surface of said condensing lens element is formed as non-spherical surface in which a radius of curvature Rv of a vertical cross section and a radius of curvature Rh of a horizontal cross section are set such that Rv>Rh.

16. The vehicular indicator lamp according to claim 11, further comprising a multiple-apertured ornamentation panel fitted to a forward side of said front lens, each lens element of said front lens being received in a respective aperture of said ornamentation panel.

17. The vehicular indicator lamp according to claim 16, wherein said multiple-apertured ornamentation panel comprises a thin sheet of non-transparent synthetic resin.

18. The vehicular indicator lamp according to claim 11, wherein said reflective surface of said reflector has a constant cross-sectional configuration over its entire circumference.

19. The vehicular indicator lamp according to claim 11, wherein a spherical concave curved surface is formed on a rear surface of said inner lens for each of said diffusion lens elements, each said spherical concave curved surface having an outline slightly small than an outline of a front surface of a respective one of said diffusion lens elements.

20. The vehicular indicator lamp according to claim 19, wherein a radius of curvature of each said spherical concave curved surface is greater than a radius of curvature of said front surface of said respective one of said diffusion lens elements.

* * * * *